US007779734B2

(12) United States Patent
Nichols, Jr.

(10) Patent No.: US 7,779,734 B2
(45) Date of Patent: Aug. 24, 2010

(54) FASTENER DRIVE-STARTER

(76) Inventor: Wade Hampton Nichols, Jr., 1211 High St., Union Grove, WI (US) 53182

( * ) Notice: Subject to any disclaimer, the term of this patent is extended or adjusted under 35 U.S.C. 154(b) by 0 days.

(21) Appl. No.: 11/943,189

(22) Filed: Nov. 20, 2007

(65) Prior Publication Data

US 2008/0156153 A1 Jul. 3, 2008

Related U.S. Application Data

(60) Provisional application No. 60/878,290, filed on Jan. 3, 2007.

(51) Int. Cl.
*B25B 23/10* (2006.01)

(52) U.S. Cl. ..... 81/452; 81/457

(58) Field of Classification Search ..... 81/451–455, 81/436–439, 491, DIG. 5; 8/456, 457; D8/456, D8/457

See application file for complete search history.

(56) References Cited

U.S. PATENT DOCUMENTS 583,158 A * 5/1897 Upham ..... 81/452
686,192 A * 11/1901 Bailey ..... 81/455
688,799 A * 12/1901 Stern ..... 81/455
942,742 A * 12/1909 Presson ..... 81/452
1,412,550 A * 4/1922 Bentley ..... 81/453
1,450,203 A 4/1923 Brown
1,497,642 A * 6/1924 Rowe ..... 81/453
1,809,719 A 6/1931 McWade
1,925,385 A * 9/1933 Humes et al. ..... 81/453
2,248,054 A * 7/1941 Becker ..... 81/457
2,399,138 A 4/1946 Nygaard
2,566,673 A 9/1951 Nygaard
2,633,168 A 3/1953 Mahaffey
2,669,896 A 2/1954 Clough
2,762,408 A 9/1956 Baldwin
2,762,409 A * 9/1956 Brasen ..... 81/453
2,765,828 A * 10/1956 Leniz ..... 81/451
2,952,285 A 9/1960 Roosli
3,901,298 A 8/1975 Eby
4,779,494 A 10/1988 Quach
5,251,520 A * 10/1993 Lanham ..... 81/436
5,355,752 A 10/1994 Keenan et al.
6,128,978 A * 10/2000 Richey ..... 81/439
6,497,166 B1 * 12/2002 Fleckenstein ..... 81/451
6,857,343 B1 2/2005 Easterbrooks et al.
7,159,493 B1 1/2007 Huang
2001/0006014 A1 * 7/2001 Cowart et al. ..... 81/437
2006/0075856 A1 4/2006 Tilton
2007/0034060 A1 * 2/2007 McCracken ..... 81/451

* cited by examiner

*Primary Examiner*—Hadi Shakeri
(74) *Attorney, Agent, or Firm*—Jansson Shupe & Munger Ltd.

(57) ABSTRACT

In the present invention, a fastener drive-starter includes a primary shaft having a hollow drive end, a drive tip within the drive end, and a spring mounted within the primary shaft biasing the drive tip toward the drive end. A releasable fastener-locking mechanism is attached to the primary shaft. A tightening member is movably mounted to the primary shaft and is movable between a first position wherein the locking mechanism is open and a second position wherein the locking mechanism is closed toward the fastener shaft at the head. The fastener is secured to the driver by pressing the fastener on the drive tip to compress the spring, moving the tightening member into its second position, and releasing the fastener such that the spring-biased drive tip presses the shaft-transverse undersurface of the fastener head against the cross-portions of the locking mechanism.

18 Claims, 3 Drawing Sheets

FASTENER DRIVE-STARTER

RELATED APPLICATIONS

This application claims the benefit of U.S. Provisional Application No. 60/878,290, filed Jan. 3, 2007.

FIELD OF THE INVENTION

This invention is related generally to handtools and, more particularly, handtools capable of holding a fastener in place during installation.

BACKGROUND OF THE INVENTION

The basic screwdriver is one of the most common hand tools in use today. In return the most common problem while using such a tool is how to begin the insertion process of a new screw. This problem is further compounded when that installation needs to take place in a tight space. Like any common problem many solutions have been developed such as the use of magnetism or split blade pressure.

For example, U.S. Pat. No. 4,779,494 issued to Quach teaches the use of friction from the unique bit design to hold a screw in place. Two L-shaped portions form the bit and those two portions are in turn moved to hold the screw through the use of a sleeve around the screwdriver.

However, while many different screw-holding screwdrivers exist, problems still exist. Magnetic tools cannot be used in many applications, such as around electronics. Friction fit screwdrivers often cannot hold the screw in place if the screw is bumped before or during installation.

SUMMARY OF THE INVENTION

A fastener drive-starter of the present invention includes a primary shaft having a drive end, a drive tip which is held in place within the drive end of the primary shaft, a spring mounted within the primary shaft pressing against the drive tip such that the drive tip is biased toward the drive end, a releasable fastener-locking mechanism which is attached to the primary shaft, and a tightening member which is movably mounted to the primary shaft. At least a portion of the primary shaft is hollow. Therefore, the tightening member is movable between a first position wherein the locking mechanism is open and a second position wherein the locking mechanism is moved into a closed position.

In some embodiments, the tightening member is a secondary shaft movably mounted around the primary shaft. The drive tip is preferably removeably mounted within the drive end of the primary shaft. It is preferred that the drive tip is releasably mounted in the primary shaft via a ball detent mechanism.

In preferred embodiments, the releasable fastener-locking mechanism includes a plurality of flexible tines. Each of the tines includes a first and second portions. The first portion has a mounted end attached to the primary shaft and a free end extending past the primary shaft. The second portion extends from the free end of the first portion substantially perpendicular to the primary shaft. In some embodiments, the second portion of the tines includes a first and second ends. The first end is attached to the free end of the first portion. It is preferred that the second end is contoured to match a shaft of a fastener. The releasable fastener-locking mechanism may have two or three tines.

The gripping fastener driver preferably includes a compression spring plate between the spring and the drive tip.

In some embodiments, the primary shaft of the inventive fastener drive-starter has a sleeve-locking extension. The secondary shaft preferably has a guide opening disposed to allow movement of the sleeve-locking extension along a length of the guide opening. The secondary shaft preferably further includes at least one locking opening in communication with the guide opening for receiving the sleeve-locking extension and holding it in place. In preferred versions of such embodiments, the secondary shaft preferably includes a plurality of locking openings. The secondary shaft along the guide opening is preferably graduated.

DETAILED DESCRIPTION OF THE PREFERRED EMBODIMENTS

Figure 1:
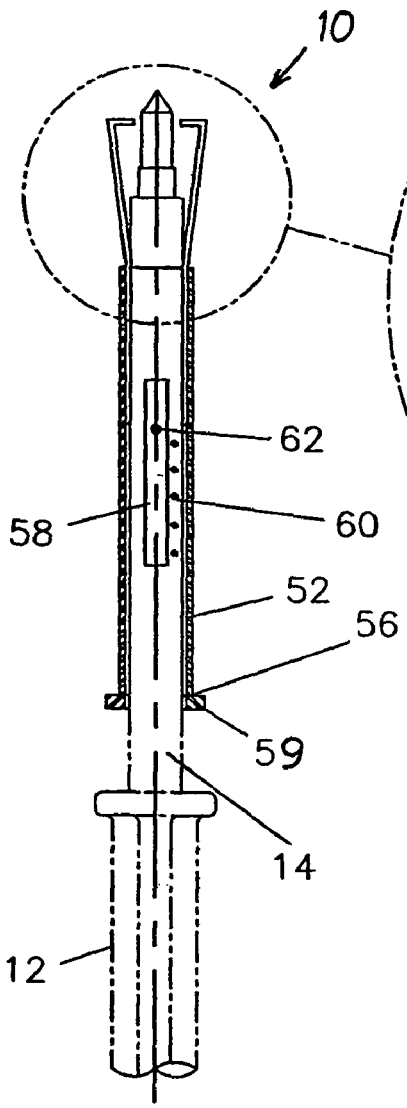
FIG. 1 is a side view of the fastener drive-starter according to the present invention.

FIGS. 1-5 show preferred embodiments of the present inventive fastener drive-starter 10. The drive-starter 10 includes a grip 12 and a primary shaft 14 attached thereto. The primary shaft 14 is an elongate shaft that includes a grip end 16 attached to the grip 12 and a drive end 18 opposite the grip end 16. The primary shaft 14 is preferably at least partially hollowed out at the drive end 18. As seen best in FIG. 2, the drive end 18 encloses a replaceable tip mechanism. The mechanism includes a spring 20 mounted within the hollow portion of the primary shaft 14. The spring 20 includes a top portion in contact with a compression spring plate 22. The compression spring plate 22 serves to facilitate a continuous connection between spring 20 and a removable bit 24. The spring 20 serves to bias the bit 24 toward the drive end 18 of drive-starter 10.

Figure 2:
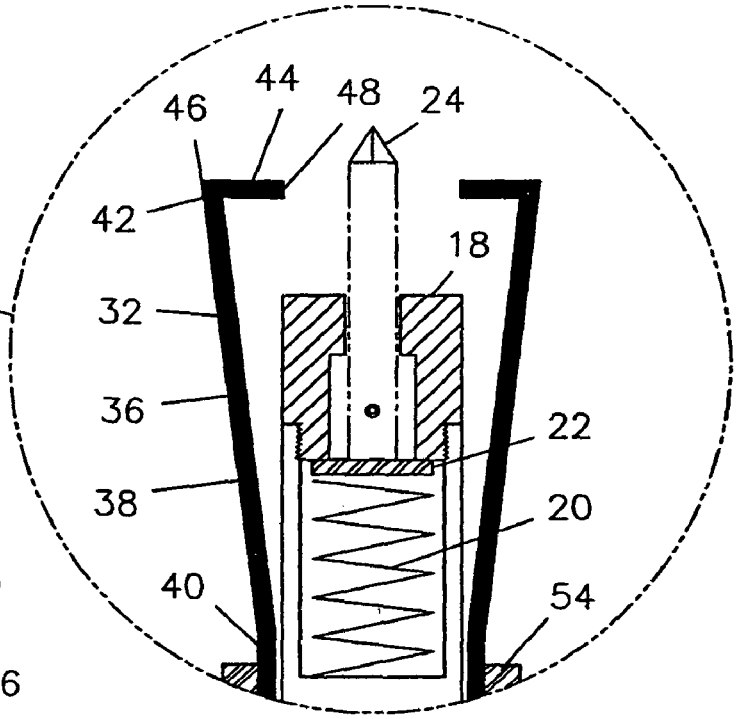
FIG. 2 is a fragmentary view of FIG. 1, including a cutaway of the primary shaft showing a spring mounted therein.
Figure 3:
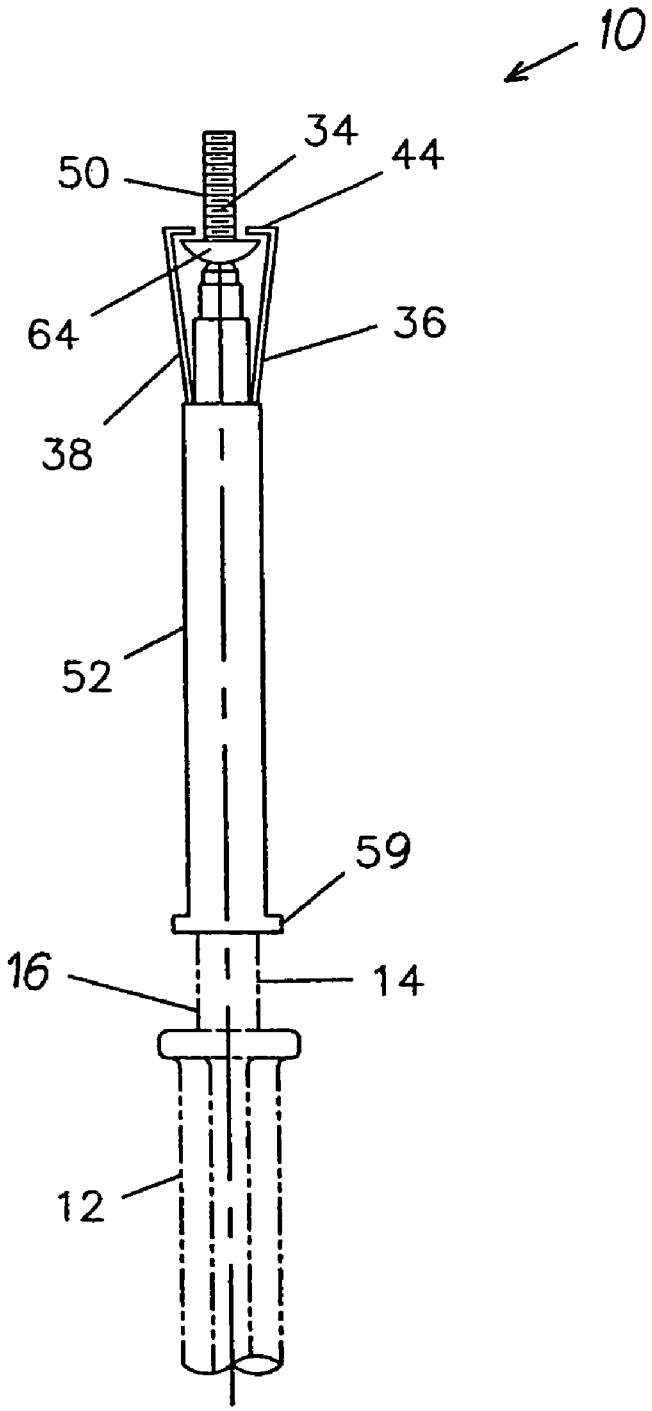
FIG. 3 is a side view of the inventive fastener drive-starter of FIG. 1 with a screw secured thereon.

FIGS. 1-3 show bit 24 as a phillips head type driver bit; however any known type of bit could be utilized. The portion of the primary shaft 14 that surrounds the bit 24 includes two portions, a first narrow portion 26 just wide enough to allow passage of the bit 24 and a second wide portion 28 to allow a ball-detent mechanism 30 to be disposed within primary shaft 14 to assist in holding the bit 24 in place.

Figure 4:
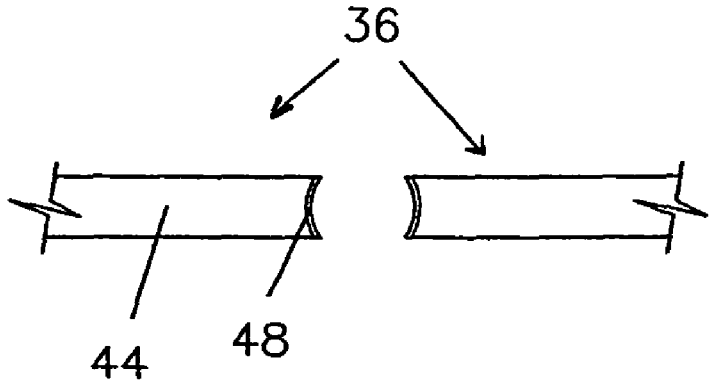
FIG. 4 is a fragmentary top plan view of a fastener-locking mechanism which includes two tines.
Figure 5:
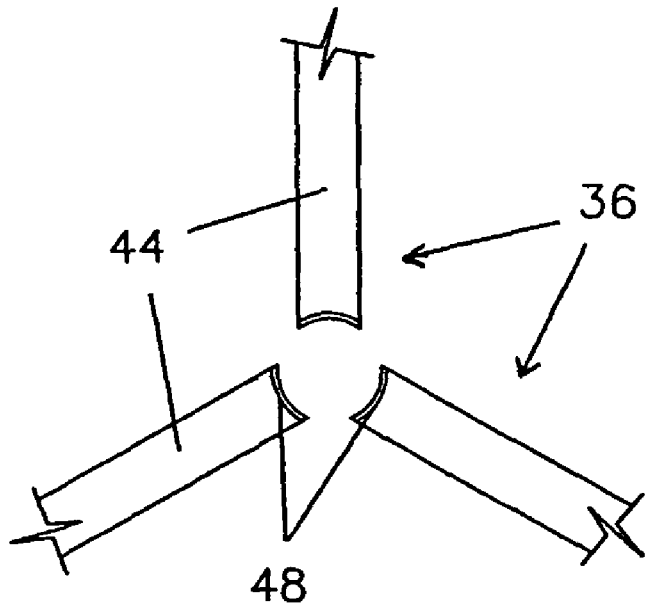
FIG. 5 is a fragmentary top plan view of a fastener-locking mechanism which includes three tines.

A releasable fastener-locking mechanism 32 extends from primary shaft 14 and acts to hold a screw 34 on bit 24. Releasable fastener-locking mechanism 32 preferably includes a plurality of flexible tines 36 extending from the primary shaft 14 and over the drive end 18. While this preferred embodiment utilizes tines, other fastener-locking mechanisms could be utilized such as a complete flexible surround rather then single tines 36. Each tine 36 includes a first portion 38 having a mounted end 40 attached to the primary shaft 14 and a free end 42 extending past the drive end 18 of the primary shaft 14. A second cross-portion 44 extends from the free end 42 and extends substantially perpendicular to the primary shaft 14. A first end 46 of each cross-portion 44 is attached to the first portion 38 and a second end 48 is free and preferably is contoured to match a shaft 50 of the screw 34. While any number of tines can be utilized, it is preferable that two or three tines 26 are utilized and spaced evenly around the primary shaft 14 as shown in FIGS. 4-5.

A tightening member in the form of a secondary shaft 52 surrounds at least a portion of the primary shaft 14. This secondary shaft 52 is slidable on the primary shaft 14 and can serve to tighten the fastener-locking mechanism 32. The secondary shaft 52 includes a first end 54 and a second end 56 opposite the first end 54 and closer to the grip 12. The second end 56 preferably includes an extension 59 substantially perpendicular to the length of the primary shaft 14 for allowing a user to move the secondary shaft 52 between an open position pulled more toward the grip 12 and a closed position pushed toward the drive end 18. In the closed position, the first portion 38 of each tine 36 is partially between the primary shaft 14 and the secondary shaft 54, thus compressing cross-portions 44 of the tines 36 toward each other.

In this preferred embodiment the secondary shaft 54 defines a guide opening 58 that is graduated for the dimensions of different screw shaft widths. To further increase the accuracy and ease of use, a plurality of locking openings 60 extend from the guide opening 58 and are of dimension to accept a sleeve-locking extension 62 that extends from the primary shaft 14 within the guide opening 58.

In operation, a user places a screw 34 on the bit 24 and presses down, compressing the spring 20. The user then pushes the secondary shaft 52 toward the drive end 18 of the primary shaft 14. This action compresses the tines 36 around the screw 34. When the proper width is reached, preferably, but not necessarily, through use of the graduated markings rather than pressing the tines 36 onto the threaded shaft of the screw 34 the secondary shaft 52 is then turned causing the sleeve-locking extension 62 to enter one of the locking openings 60 and holding the secondary shaft 54 and thus the screw 34 in place. Once the screw is released, the spring 20 presses the head 64 of the screw 34 against the tines 36. The screw 34 can then be safely secured in whatever setting is necessary. Once the screw 34 is secured, the secondary shaft 52 can be pulled toward the grip 12 thus releasing tension on the tines 36 and allowing the drive-starter 10 to be pulled away.

While the principles of the invention have been shown and described in connection with specific embodiments, it is to be understood that such embodiments are by way of example and are not limiting.

The invention claimed is:

1. A fastener drive-starter for a fastener with a head and a fastener shaft extending from a shaft-transverse head undersurface, comprising:

a grip;

a primary shaft extending along an axis and having a grip end attached to the grip and a hollow drive end opposite the grip end;

a drive tip movably positioned within the hollow drive end of the primary shaft;

a spring within the primary shaft and providing an axial force biasing the drive tip toward the drive end;

a releasable fastener-locking mechanism extending between a mounted end non-movably attached to the primary shaft and a free end extending past the primary shaft to terminate with cross-portions extending substantially perpendicular to the axis; and a tightening member movably mounted to the primary shaft, the tightening member movable between a first position wherein the locking mechanism is open and a second position wherein the locking mechanism is closed toward the fastener shaft at the head such that the shaft-transverse head undersurface against the cross-portions which creates an axial force-resistance opposing the axial force, whereby the fastener is secured to the drive-starter by the axial force and opposing force-resistance sandwiching the fastener head between the tip and the cross-portions.

2. The fastener drive-starter of claim 1 wherein the tightening member is a secondary shaft movably mounted around the primary shaft.

3. The fastener drive-starter of claim 2 wherein:

the primary shaft has a sleeve-locking extension; and the secondary shaft has (a) a guide opening disposed to allow movement of the sleeve-locking extension along a length of the guide opening and (b) at least one locking opening in communication with the guide opening for receiving the sleeve-locking extension and holding it in place.

4. The fastener drive-starter of claim 3 further including a plurality of locking openings.

5. The fastener drive-starter of claim 4 wherein the secondary shaft along the guide opening is graduated.

6. The fastener drive-starter of claim 1 wherein the drive tip is removably mounted within the drive end of the primary shaft.

7. The fastener drive-starter of claim 6 further comprising a spring-engaging plate between the spring and the drive tip.

8. The fastener drive-starter of claim 6 wherein the drive tips releasably mounted in the primary shaft via a ball detent mechanism.

9. The fastener drive-starter of claim 1 wherein the releasable fastener-locking mechanism includes a plurality of flexible tines.

10. The fastener drive-starter of claim 9 wherein each tine includes (a) a first portion having the mounted end non-movably attached to the primary shaft and the free end extending past the primary shaft and (b) a corresponding one of the cross-portions extending toward the axis from the free end of the first portion.

11. The fastener drive-starter of claim 10 wherein the cross-portion is configured for engagement with the fastener shaft.

12. The fastener drive-starter of claim 11 wherein the cross-portion of each tine includes a first end attached to the free end of the first portion and a second end.

13. The fastener drive-starter of claim 12 having three tines.

14. A method for secure holding of a fastener to start the driving thereof, the fastener having a head and a fastener shaft extending from a shaft-transverse head undersurface, the method comprising:

providing a fastener drive-starter including:

a grip;

a primary shaft extending along an axis and having a grip end attached to the grip and a hollow drive end opposite the grip end;

a drive tip movably positioned within the hollow drive end of the primary shaft;

a spring within the primary shaft and providing an axial force biasing the drive tip toward the drive end;

a releasable fastener-locking mechanism extending between a mounted end non-movably attached to the primary shaft and a free end extending past the primary shaft to terminate with cross-portions extending substantially perpendicular to the axis; and a tightening member movably mounted to the primary shaft, the tightening member movable between a first position wherein the locking mechanism is open and a second position wherein the locking mechanism is closed toward the fastener shaft at the head such that the shaft-transverse head undersurface against the cross-portions which creates an axial force-resistance opposing the axial force, placing the fastener on the drive tip;

pressing the fastener head on the drive tip to compress the spring;

moving the tightening member from the first position with the locking mechanism open to the second position with the locking mechanism closed toward the fastener shaft at the head; and releasing the fastener such that the axial force of the spring-biased drive tip presses the shaft-transverse undersurface of the fastener head against the cross-portions of the locking mechanism which creates an axial force-resistance opposite the axial force, whereby the drive-starter securely holds the fastener by the axial force and the opposing force-resistance sandwiching the fastener head between the tip and the cross-portions.

15. The method of claim 14 wherein the releasable fastener-locking mechanism includes a plurality of flexible tines.

16. The method of claim 15 wherein each tine includes:

a mounted portion having the mounted end attached to the primary shaft and the free end extending past the primary shaft; and the cross-portion extending from the free end of the first portion.

17. The method of claim 16 wherein:

the primary shaft of the drive-starter has a locking extension;

the tightening member has (a) a guide opening disposed to allow movement of the locking extension along a length of the guide opening and (b) at least one locking opening in communication with the guide opening for receiving the locking extension; and the method further includes the step, after moving, of turning the tightening member to cause the locking extension to enter the locking opening for holding the tightening member in its second position.

18. The method of claim 17 wherein the secondary shaft has a plurality of locking openings and is graduated thereal-ong for compressing the tines to close at specific widths.

* * * * *